US005826977A

United States Patent [19]

Fowler et al.

[11] Patent Number: 5,826,977

[45] Date of Patent: Oct. 27, 1998

[54] METHOD FOR MIXING LAMINAR AND TURBULENT FLOW STREAMS

[75] Inventors: James E. Fowler, Watertown, Mass.; Paul K. Hsei, Huntington Beach, Calif.

[73] Assignee: Nova Biomedical Corporation, Waltham, Mass.

[21] Appl. No.: 63,966

[22] Filed: Apr. 21, 1998

Related U.S. Application Data

[62] Division of Ser. No. 702,967, Aug. 26, 1996.

[51] Int. Cl.[6] ..... B01F 5/06

[52] U.S. Cl. ..... 366/348

[58] Field of Search ..... 366/181.5, 336–340, 366/348; 138/37, 39; 48/189.4

[56] References Cited

U.S. PATENT DOCUMENTS

| | | | |
|---|---|---|---|
| 3,159,312 | 12/1964 | Van Sciver, II | 366/336 X |
| 3,476,521 | 11/1969 | Wise | 366/181.5 X |
| 3,643,927 | 2/1972 | Crouch . | |
| 3,701,619 | 10/1972 | Appeldoorn et al. | 366/336 X |
| 3,831,904 | 8/1974 | Appeldoorn et al. | 366/337 |
| 3,881,701 | 5/1975 | Schoenman et al. | 366/340 X |
| 4,027,857 | 6/1977 | Cunningham | 366/340 |
| 4,198,168 | 4/1980 | Penn | 366/348 X |
| 4,222,671 | 9/1980 | Gilmore . | |
| 4,316,673 | 2/1982 | Speer . | |
| 4,461,579 | 7/1984 | McCallum . | |
| 5,516,209 | 5/1996 | Flint et al. | 366/336 X |

*Primary Examiner*—Charles E. Cooley
*Attorney, Agent, or Firm*—Robert R. Deleault, Esq.; Mesmer Law Offices, P.A.

[57] ABSTRACT

A method of mixing substances under either laminar flow or turbulent flow conditions, or substances having a combination of laminar flow conditions. The method includes combining two or more initial fluidic substances into a combined fluid stream, dividing the combined fluid stream into two or more separate fluid streams, changing the shape of each of the two or more separate fluid streams in preparation for layering the two or more separate fluid streams together into a subsequent combined fluid stream such that each subsequent combined fluid stream has the same cross-sectional shape as the initial combined fluid stream and such that the cross-sectional area of the fluid stream is constant, and repeating the dividing, shaping and layering of the subsequent combined fluid stream at least one or more times.

11 Claims, 10 Drawing Sheets

METHOD FOR MIXING LAMINAR AND TURBULENT FLOW STREAMS

This is a division of application Ser. No. 08/702,967, filed Aug. 26, 1996.

BACKGROUND OF THE INVENTION

1. Field of the Invention

The present invention relates generally to static mixers that have no moving parts for mixing various substances together. Particularly, this invention relates to a static mixer that mixes two substances independent of the substances' viscosity and of the speed at which the substances travel through the mixer's path. More particularly, this invention relates to a static mixer which provides complete mixing of two substances in both laminar and turbulent flow streams. Even more particularly, this invention relates to a static mixer which accomplishes the mixing process using a plurality of combining, stacking and splitting steps and to a mixing method which accomplishes the mixing process without relying on boundary-layer effects.

2. Description of the Prior Art

In our daily lives and in various industries, there is a common need to homogeneously mix two or more fluidic substances, which fluids may be liquids, gases and even fluidized solids. Through the years, people have tried different methods to accomplish this purpose. One method is to cause a shearing effect in the substances by using a stirring rod or blade of dynamic mixers. This is accomplished either manually or with the help of a power-driven motor. Other methods used no moving parts to accomplish the random mixing of the substances. Devices that use these other methods are known as static mixers or interfacial surface generators.

Static mixers are well known in the art as a means for mixing a plurality of materials into a single homogeneous mass without the need for moving mixing blades and paddles or the need for ultrasonic radio-waves to accomplish the mixing. These static mixers are particularly useful in various applications such as mixing chemicals in industrial processes, mixing multi-part curing systems in adhesives, foams and molding compounds, mixing fuels and gases for combustion, mixing air into water for sewerage treatment, or wherever mixing needs to be accomplished in a flowing/stream process. However, all of the prior-art devices rely on the boundary-layer effect to create turbulence within the flow stream. The boundary layer effect limits the useable range of substances in these prior-art devices to those whose flow characteristics fall within a given viscosity and flow rate range.

In many situations, the thoroughness of the mixing process is critical to the end product or result. For instance, the adhesive strength of two-part adhesives is related to the proper mixing of the component parts. Also, some measuring instruments require various, pre-calibrated standards for establishing the reliability of the measurement process. Oftentimes, this is performed before and after the unknown sample is analyzed. Furthermore, some manufactured products and manufacturing processes are very cost sensitive due to market forces primarily caused by competition in the marketplace. These products or processes require a mixing of materials that is economical and efficient in order for these products to remain competitive.

The cost of a static mixer and the cost of using it are influenced by several factors. These factors include the size of the mixer, the cost of fabrication, the ease of assembly, and the ease of cleaning. Obviously, the size of the mixer will influence the amount of material used in its manufacture. The more material required in its manufacture, the greater the cost. Some of the currently available static mixers use a helical, twisting pattern of the components to effect mixing. This is generally accomplished by forming a pair or more of short twisted helix elements that are connected orthogonally at their ends to both split the stream and reverse its helical flow path between each element. These inter-connected helical elements are then inserted into a container having a tube-shaped passageway and fixed into position. The number of steps required to assemble such a static mixer has a direct effect on the cost of fabrication.

Because some mixtures such as adhesives may begin the setting and curing process that they undergo as they pass through a static mixer, the devices incorporating twisted helix elements present cleaning problems for the user. That is, it is difficult to remove completely all of the mixture components. Consequently, these kinds of static mixers may be used only once or for a limited number of times. Other prior-art devices have reduced the cleaning problems by manufacturing static mixers that can be broken down into several component parts. These multi-component devices allow easier access to the flow path of the mixer but still harbor small recesses that are difficult to clean.

The thoroughness of the mixing action of all of the prior devices, whether they are composed of the twisted helix elements inserted into a tube-like passageway or whether they are the multi-component devices mentioned above, is influenced by the fluid flow characteristics of the substances. There are generally two distinct types of fluid flow that are universally accepted phenomena, laminar flow and turbulent flow. In laminar flow, the fluid flows in smooth layers or lamina. This occurs when adjacent fluid layers slide smoothly over one another with mixing between layers or lamina occurring only on a molecular level. Little, if any, mixing occurs in this type of fluid flow. Turbulent flow is characterized by the large scale, observable fluctuations in fluid and flow properties. This particular flow regime is where small packets of fluid particles are transferred between layers. Mixing of two or more substances in this turbulent flow regime occurs easily and rather thoroughly.

It is well know in the art that there exists a transition point where laminar flow transforms to turbulent flow. The major characteristics that cause a particular fluid flow to be either laminar, turbulent or a mix of the two, are 1) the viscosity of the substances, 2) the flow rate of the substances, 3) the diameter of the flow path, and 4) the fluid density. The more viscous two materials are, the higher the flow rate required in order to create a turbulent flow. These four variables combine into a single dimensionless parameter called the Reynolds Number and is represented by the equation $$Re \equiv \frac{D\rho v}{\mu} .$$

Generally, laminar flow is less than 2300 and turbulent flow is greater than 2300, with some exceptions.

Because laminar flow of two substances does not result in the mixing of those substances, all of the prior-art static mixing devices rely on the creation of turbulent flow to carry out the mixing process. This is achieved by placing obstacles in the flow path or by combining, splitting and re-combining the fluid in the flow path as it passes through various twists and turns. This is done to achieve areas in the flow path where the fluid stream is subjected to strong mixing action as occurs with the helical design. These areas are called strong mixing zones. Regardless of the type of design used, the Reynolds number developed by the fluid must be sufficiently high to cause a transition from laminar to turbulent flow. Otherwise, the mixing results are apt to be random having areas of incomplete mixing within the fluid mass volume. As mentioned earlier, the Reynolds number is viscosity and flow rate dependent. For high viscosity fluids, the flow rate of the fluids must be relatively fast. Otherwise, laminar flow occurs. To achieve these higher flow rates, a static mixer having a flow path with a small cross-sectional diameter requires a larger amount of head pressure on the fluid stream. This larger head pressure is required to push the fluids through the static mixer whereby turbulent flow is achieved.

Many such devices have been devised in the past. Currently, some of the prior-art devices insert spiral-type blades into a tube to divide the material. These devices rely on the surface friction caused by the boundary layer to randomly flip the flow for the next division. Others use two concentric tubes to direct the substances at high speed into each other. These devices rely on the shearing and swirling effect, caused when the two passageways converge on one another, to do the mixing.

U.S. Pat. No. 4,461,579 (1984, McCallum) teaches a motionless mixer combination having basic mixer components formed from flat stock. The basic mixer component consists of an isosceles triangular base plate and a pair of vanes connected at equal and opposite angles to the legs of the triangle of the base plate. A series of these basic mixer components are placed inside of a conduit pipe section to form the motionless (static) mixer combination. Each basic mixer component has the following effect on a flow stream. It equally divides the flow stream, rotates each divided stream around each other and then recombines the flow stream. There are several disadvantages associated with this device. This device relies on the shearing or swirling effect to change the orientation of the material before combining. Different mixing results will be achieved based on a material's viscosity, a key characteristic which influences a material's Reynolds number particular to this mixer. Another disadvantage is that this device is hard to construct. Each basic mixer component must be precisely bent, attached to the next basic mixer component and assembled into a conduit pipe section. The complexity of the manufacturing steps and the labor involved also makes the device hard to miniaturize. Furthermore, this device cannot be easily cleaned or repaired. Also, the effectiveness of the mixing decreases with its cross-sectional area because the device depends on the surface friction, i.e. boundary layer effect, to change the pattern of the material before combining. The mixing action also relies on a strong mixing zone in which splitting and shearing of the fluid stream occurs and which results in turbulent flow. In fluid streams with relatively low Reynolds numbers (laminar flow), complete mixing would not occur.

U.S. Pat. No. 3,643,927 (1972, Crouch) teaches a static mixer and a method for mixing material in a flowing stream. The static mixer consists of a conduit having at least a pair of material-guiding plates for dividing, rotating and combining the divided streams of material about the axis of the conduit. This device relies on a shearing, separating and tumbling effect to mix the material passing through this mixer. Consequently, only material that can be sheared, separated and mixed by a tumbling action can be used with this device. Therefore, material which exhibits low Reynolds numbers, i.e. laminar flow, will not mix. As the viscosity and Reynolds numbers of the input materials change, so will the mixing results. That is, complete mixing may not occur where material viscosity is high and material flow rate is low. Other disadvantages of this device is that it is hard to construct, repair and clean. It also cannot be easily miniaturized for the same reasons stated above for the McCallum device.

U.S. Pat. No. 4,222,671 (1980, Gilmore) teaches a static mixer having mixing structure that combines, divides and recombines streams of flowing materials in a passageway by rotating the flow path and altering the cross-sectional shape of the flow paths to obtain mixing. The mixing structure consists of flow passage sections and flow rotator sections. The flow passage sections extend along a path that bends about an axis perpendicular to the direction of flow causing turbulence within each branch of the flow passage section. The flow rotator sections are positioned in intermediate plates between the flow passage sections. The flow passage sections facilitate mixing and achieve curvature of the path to enable it to cross and re-cross the several boundary surfaces between adjacent plates and the laminated body of flow-rotator sections. The flow rotator sections are positioned in intermediate plates to provide a linear flow path. Like the other prior-art devices, this device depends on the surface friction, i.e. boundary layer effect, to change the cross-sectional pattern of the material causing the material to tumble before combining. This change in pattern causes turbulent flow within the fluid stream. Again, this device is difficult to construct, repair and clean, especially when multiple flow rotator sections are used. The variable cross-sectional flow caused by using multiple flow rotator sections makes the assembled device difficult to wash out. This device also cannot be miniaturized easily for the same reasons stated earlier. Furthermore, the flow path pattern of this device makes it more likely to trap small air bubbles in various locations within the mixer.

U.S. Pat. No. 4,316,673 (1982, Speer) teaches a molded, disposable mixing device for simultaneously dispensing two-part liquid compounds from a packaging kit. The device consists of two mirror-imaged, semi-circular structures having a tortuous path for shearing, folding, mixing, and blending together the two fluids. The tortuous path consists, generally, of one of the following types of passageways. The tortuous path may be two periodically intersecting paths, or a generally open passage provided with mixing blades or baffles disposed at regular or irregular intervals, or a spirally-folded mesh or spherical objects disposed in a single tubular structure. As with all previous devices discussed, this device relies on creating a turbulent flow to bring about mixing of the two-part liquid. High viscosity liquids require very high flow rates to reach sufficiently high Reynolds numbers for turbulence to occur, and thus to effect mixing. Otherwise, laminar flow will result, causing no mixing or, at best, incomplete mixing of the two liquids at the device's exit port.

Therefore, what is needed is a static mixer that is inexpensive and easy to manufacture. What is also needed is a static mixer that is easy to clean and repair. What is further needed is a static mixer that can be made into any size specific to its application from large industrial processes to ultra-small and microscopic processes. What is still further needed is a static mixer that does not rely on the boundary-layer effects of a flow stream for complete mixing of the materials in the stream. Finally, what is needed is a static mixer that accomplishes complete mixing of any substances regardless of the type of flow regime present, laminar or turbulent.

SUMMARY OF THE INVENTION

It is an object of the present invention to provide a static mixer that is inexpensive and easy to manufacture. It is another object of the present invention to provide a static mixer that is easy to clean and repair. It is a further object of the present invention to provide a static mixer that can be made into any functional size, for use in applications from large industrial processes to ultra-small and microscopic processes. It is yet a further object of the present invention to provide a static mixer that does not rely on the boundary-layer effects of a flow stream to ensure complete mixing of the fluids in the stream. Still a further object of the present invention is to provide a static mixer and a method of mixing that accomplishes complete mixing of both laminar and turbulent flow streams.

The present invention achieves these and other objectives by providing a static mixer having a structure that totally controls the flow pattern of the fluids being mixed. That is, the present invention does not rely on the boundary-layer effect or flow to achieve the desired results. The boundary-layer effect is the effect developed by the shear stress on the fluid stream at the boundary layer interface between the stream and the mixer walls. The boundary-layer effect limits the useable range of substances in prior-art devices to those whose flow characteristics fall within a given viscosity and flow rate window. This is so because all prior-art devices rely on turbulent flow in order to attain complete mixing. In the present invention, the boundary-layer effect has no bearing on the completeness of the mixing. The present invention accomplishes the mixing process even in laminar flow situations. That is, high viscosity substances with low flow rates will also become sufficiently mixed when passed through the present invention whether those substances are gases, liquids, powders, sludge, paste, etc.

The present invention includes two identical components that create a passageway, when combined together, that splits, flips, stacks and re-combines a stream of flowing material. Unlike prior-art devices whose identical pieces are mirror images because of their individual symmetry, the two identical components of the present invention are not mirror images of each other. By using multiple, repetitive patterns where each pattern splits, flips, stacks, and re-combines the substances flowing through the passageway, the present invention accomplishes its mixing task even on flowing substances exhibiting laminar flow, substances that cannot be thoroughly mixed by prior-art static mixer devices. Each repetitive pattern or segment divides and stacks the incoming materials before the materials enter the next segment. With the addition of each additional repetitive pattern or segment, dividing and stacking occurs in the present invention at $2^{n+1}$ times, where "n" represents the number of segments or repetitions.

In addition to achieving the above-mentioned division and stacking in the power of $2^{n+1}$ for each repetition, the present invention, by holding the cross-sectional area constant throughout the flow path, reduces the layer thickness of each stack after division by half every time the material passes through a "repetition." This method of reducing the divided thickness into $\frac{1}{2}^n$ of the previous thickness and of stacking one layer on top of the other layer effectively mixes the flowing material continuously and without turbulence. A device based on the present invention's design having 23 repetitions, for example, will divide the stream into 16,777,216 layers laminated together. It is observed that material undergoing this many subdivisions and layers becomes thoroughly mixed.

Although the previous description describes the preferred design of the present invention, this same concept would also work on an open conduit such as a trench, possessing the same design concepts used for the flow path of the above-described mixer. So long as the fluid stream is sufficient to be split into substantially equal flows, the mixing of the fluid stream would occur in the same way. Of course, this open conduit would only work in gravity feed type situations.

The design of the flow passageway of the present invention achieves mixing of materials under laminar flow conditions by its unique design and the design's effect on the material passing through the device. The design of the passageway of the present invention successively moves the boundary layer of the material from the center of the stream to the boundary each time the material passes through a repetition. In other words, the material at the boundary layer created upon contact with the splitting component, which is at the center of the stream, moves to the outside of the stream when the two flow streams re-combine before entering the next segment or repetition. As material passes through the next repetition, the material that was at the center of the stream in the previous segment now moves to the outside edge of the flow stream in the current segment. This movement from center to outside continues for each successive segment or repetition.

By changing the boundary layer position in such a way, the design of the present invention eliminates the boundary-layer effect common with all prior-art devices which prevents a thorough mixing of fluidic material under laminar flow conditions. This controlled movement of the material through the repetitions of the present invention takes the randomness of the results out of the mixing equation, which is characteristic of all prior-art devices when mixing materials under laminar flow conditions or under flow conditions having a mix of laminar and turbulent flow. Unlike the prior-art devices, the present invention is very consistent in its mixing results regardless of the type of flow regime.

The static mixer of the present invention is formed by the joining of two identical segments. At one end of the joined pair, there is an input port for each material. At the opposite end, there is at least one exit port for the flowing material. A plurality of exit ports may be used if so desired. Between the input and output ends of the present invention, there lies a plurality of segments of the passageway formed by the combination of the two identical halves. Each segment splits, shapes, stacks, and combines the flowing material. As previously mentioned, the number of times the material passes through a repetition determines how many times the stream of material is divided and how many layers of material are created.

As material passes through each repetition, the cross-sectional dimension of the material changes, but not its cross-sectional area. When the material flow is at the point of the splitting action, the cross-sectional configuration of the mass is more like an elongated, rectangular volume where the horizontal sides of the volume are shorter than the vertical sides of the volume. When viewed from this perspective, the splitting component is perpendicular to the horizontal side of the volume and is centered along the axis of the static mixer. The axis is the centerline of the present invention running along the direction of material flow when both halves of the device are joined. As the material is split, an equal volume of material is diverted to each side of the splitting component. The cross-sectional areas of the passageways on either side of the split are approximately one-half of the cross-sectional area of the material mass existing before the material mass contacts the splitting component.

Immediately after passing the splitting component of the present invention, the two parts of the flowing stream undergo simultaneous changes in flow direction. Each part of the flow stream is guided away from the axis of the present invention both in an "X" and a "Y" direction. During the flow stream's journey away from the center axis of the present invention, its cross-sectional shape changes to a rectangular volume with its horizontal side becoming longer and its vertical side becoming shorter. At the point where each part of the flow stream has undergone its maximum cross-sectional shape change, each individual part of the flow stream changes its flow direction towards the axis of the present invention. When each part of the flow stream re-combines with the other parts and they stack together prior to the next splitting component, the cross-sectional shape of the stacked flow is returned to the flow stream's original cross-sectional shape.

By holding the cross-sectional areas throughout the flow path the same, the present invention reduces by half the layer thickness of each stack after division as the material passes through each repetition. This method of reducing the divided thickness into $\frac{1}{2}^n$ of the previous thickness and stacking one on top of the other effectively mixes the flowing material continuously as the material passes through a total of 23 segments or repetitions. Because the present invention is consistent in its mixing effectiveness, substances under laminar flow conditions will also be mixed as the material exits through the output port of the mixer.

The versatility of the present invention allows one to fabricate the identical halves from any material, including metal and plastic. The material used to fabricate the present invention should be inert so that it will not react with the flow stream substances. For example, if the flow stream substances are liquids, the material used for fabricating the present invention should not be soluble in either of the flow stream substances, individually or in their resultant combination. The individual mixer segments can be formed into a base material by molding or machining these segments. Because size of the segments or, for that matter, the size of the identical halves is not relevant to the successful use of the mixer, the present invention may be machined using lasers or may be etched onto substrates in a way similar to that used to create integrated circuits. In this way, smaller and smaller volumes of material can be continuously mixed for use as calibration standards, for example. This can lead to further miniaturization of various processes encountered in a variety of fields such as quality control, medical diagnostics, chemical reaction analysis, mold injection of miniaturized devices. etc. It should be noted that, for large-scale industrial-sized mixers, the flow paths may be machined or cast into a single block of material. For example, a single block can be cast or molded about a dissolvable flow path model. Once cast or molded, the flow path model can be dissolved away, leaving a block with the mixer path in place.

The two identical, non-mirror-imaged halves having a plurality of splitting, shaping, stacking, and combining segments are connected to each other using a variety of fastening methods such that the sides with the segments are facing each other and the input ports are on the same end. Screws, clamps, bands and other fastening means secure the two halves to each other during use. Obviously, the fastening means selected would be based on the overall size of the static mixer, the type of material used to fabricate the mixer, the type and variety of substances that are conducted through the passageway for mixing, and various other application parameters. For instance, if cleaning of the device is required after each use, then a fastening means that allows for quick separation and access to the flow paths would be desirable. On the other hand, if the same substances are always used and those substances are of the same quality, then a more permanent and secure method of fastening the static mixer could be used.

The mixing method of the present invention involves splitting a flow stream into substantially equal flows by a single splitting component, reshaping each substantially equal flow and then stacking or layering the re-shaped, substantially equal flows together prior to undergoing subsequent repetitions of the same process to accomplish the mixing. Although there is a mathematical advantage to dividing the flow stream into two substantially equal flows, it is conceivable to split the flow stream into other than two equal flows. For example, the stream could be split into ¾–¼ flows or into any other ratio one desires. Naturally, this alternative splitting will cause one part of the flow which becomes one layer to be thicker than the second part of the flow. The effectiveness of mixing in this situation will decrease proportionally with the degree of unequal division. Also, it is possible to split the fluid stream into more than two flows, followed by shaping, stacking and layering/re-combining. This would accomplish the dividing and stacking according to the formula $fm^n$, where "f" represents the number of "fluids" that initially enter the mixer, "m" represents the number of flows or parts the fluid stream is split into and "n" is the number of repetitions.

The present invention has several preferred embodiments. The first two employ two similar halves which are fastened together forming the flow path to be followed by the materials as they pass through the mixing chambers. There is generally an input port or conduit on one end in each half of the mated device where the materials enter into the plurality of mixing segments. Normally, the opposite end of the device has a single output port or conduit from which the mixed materials exit after passing through the plurality of mixing segments. The only difference between the first two embodiments is the direction of the flow paths. This difference is most easily perceived by viewing the flow path of one-half of each embodiment. In the first embodiment, each flow path appears to zigzag about the center axis of the flow path. In the second embodiment, the flow path appears to remain on the same side of the center axis and looks like a series of waves.

A third embodiment of the present invention includes one or more divider portions between two identical outer portions. In order to put more "repetitions" in a given length of the mixer, the angle between the two combining flow streams or paths is increased. As the two flow streams combine by stacking inside each repetition, the relative speed of the cross-flow at the interface perpendicular to the longitudinal axis of the mixer increases as the angle becomes larger. To ensure that the materials in the flow streams do not mingle together prematurely during the stacking phases, a divider is introduced between the two identical "halves." In actual tests, the divider becomes insignificant to the mixing process after about five repetitions. That is, each repetition being one full segment described earlier.

The key to all of the embodiments of the present invention is the control of the flow streams by the stacking process and the unidirectional splitting. The following is one way to visualize the stacking process as the material flows through one segment or repetition. The stacking process is like cutting a deck of cards right in the middle and then sliding the bottom half of the deck onto the top half of the deck.

All of the advantages of the present invention will be clear upon review of the detailed description, drawings and appended claims.

DETAILED DESCRIPTION OF THE PREFERRED EMBODIMENT

Figure 1:
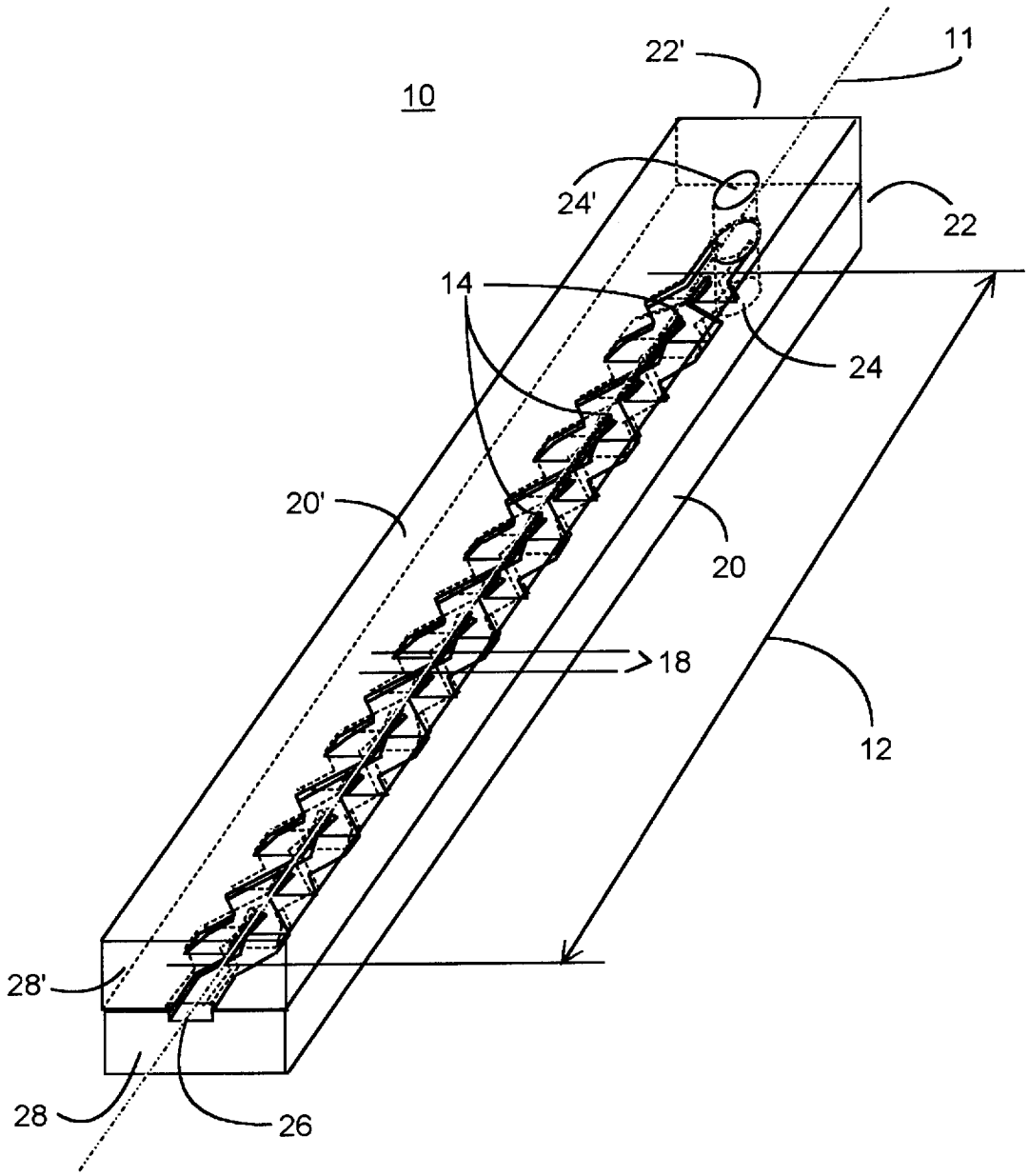
FIG. 1 is a perspective view of the present invention showing the two identical halves combined together forming the mixing paths of the static mixer.

The preferred embodiment of the present invention and the novel method of mixing laminar flows accomplished by the present invention by splitting, shaping and stacking the flow streams in a controlled manner without moving parts such as paddles, blades and the like, are illustrated in FIGS. 1–10. FIG. 1 shows a static mixer 10 for laminar flow streams having a first mixing path module 20 and a second mixing path module 20' removably attached to each other forming the mixing path 12. A pair of intake paths 24 and 24' on a first end 22 of first mixing path module 20 and a first end 22' of second mixing path module 20', respectively, are in connective registry with mixing path 12 of static mixer 10. An outlet path 26, also in connective registry with mixing path 12, is formed when a second end 28 of first mixing path module 20 and second end 28' of second mixing path module 20' are joined together. Stacking or layering of the flow streams occurs in layering zone 18. For reference purposes, a mixer axis 11 runs centrally through static mixer 10.

Figure 2:
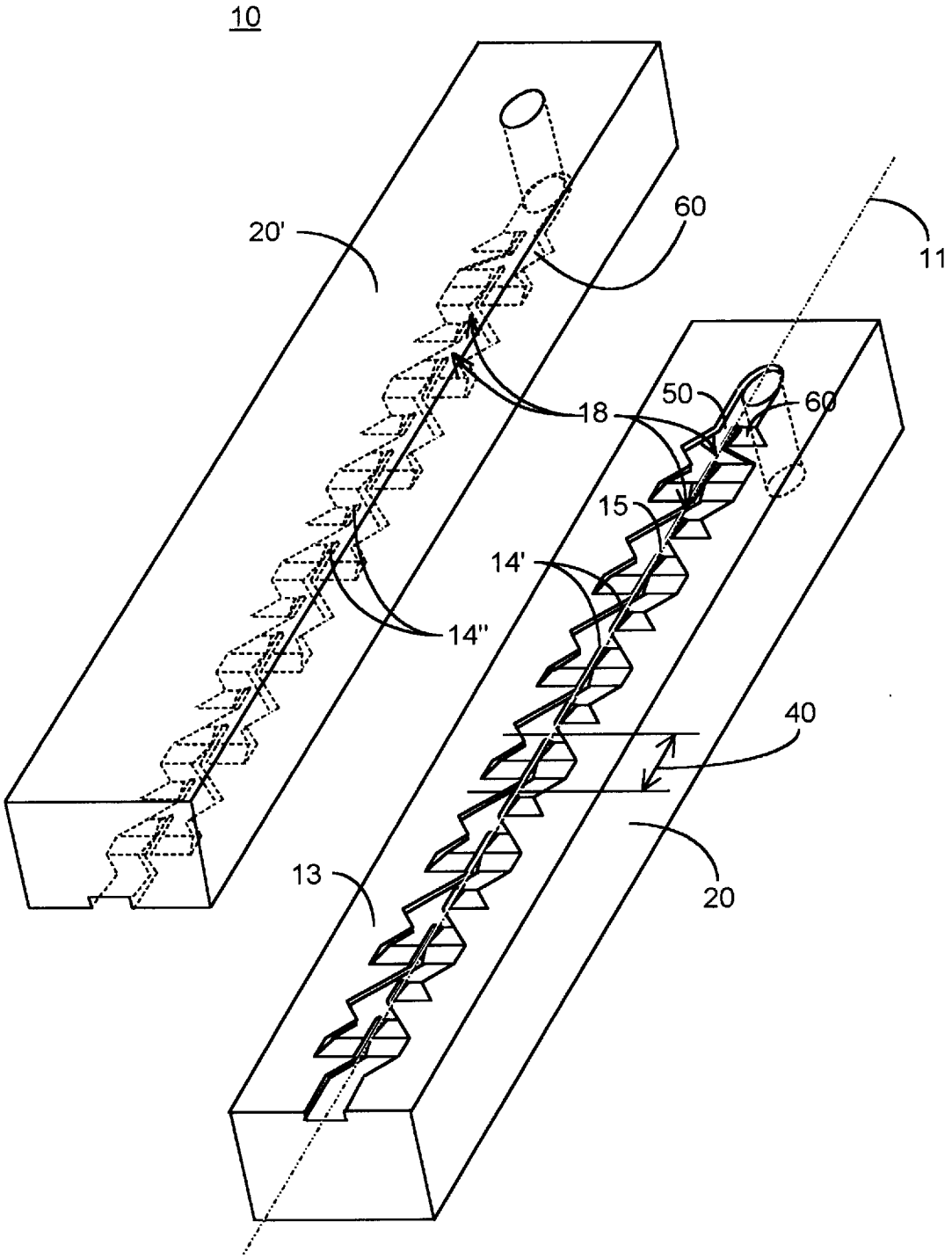
FIG. 2 is a perspective view of the present invention showing the two identical halves separated showing the form of one-half of the mixing path.
Figure 3:
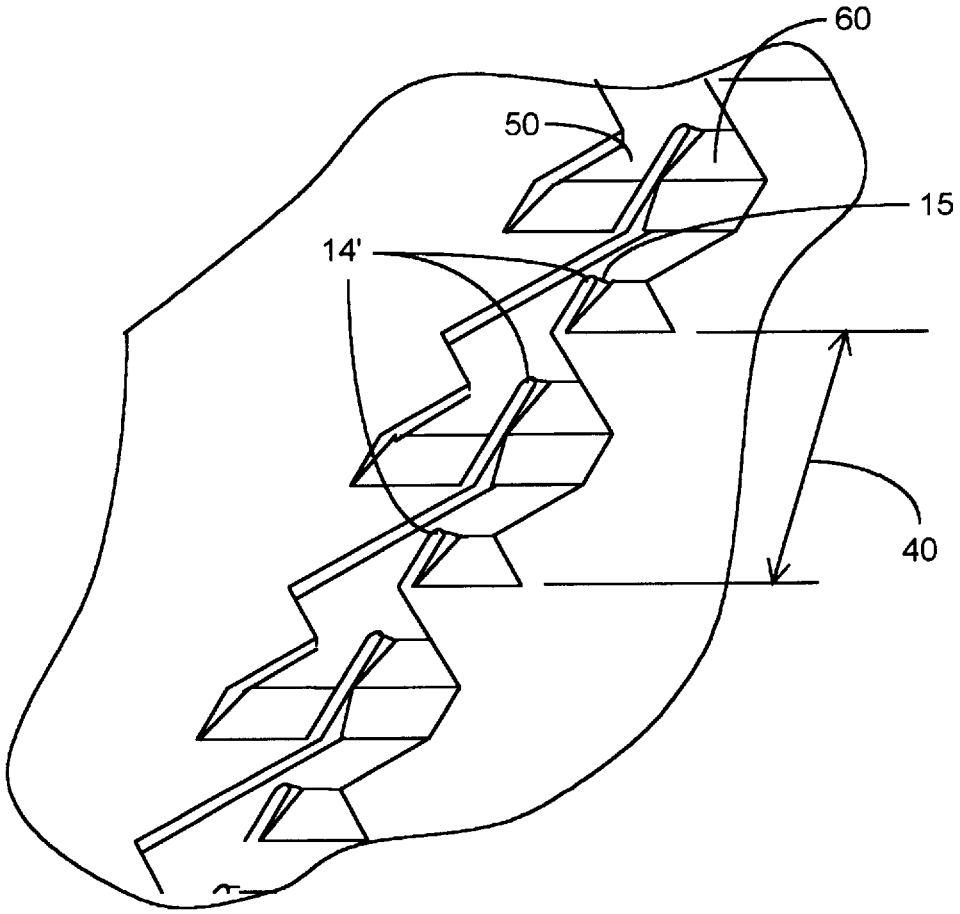
FIG. 3 is a perspective view of the present invention showing several mixing segments enlarged to provide more detail of the flow path.

FIG. 2 shows first mixing path module 20 and second mixing path module 20' of static mixer 10 separated from each other to more clearly show various components of the mixing path 12. The mixer axis 11 is pictured as lying in the same plane as a mating side 13 of first mixing path module 20. The mixing path 12 contains a plurality of mixing segments 40. Each mixing segment 40 further includes a splitting component 14, a first flow path 50, a second flow path 60 and layering zone 18. Splitting component 14 is formed when a first splitting portion 14' of first mixing module 20 and a second splitting portion 14" of second mixing module 20' are mated, with splitting component 14 transecting the entire mixing path 12. Similarly, layering zone 18 is formed when first mixing module 20 and second mixing module 20' are joined. FIG. 3 shows an enlarged view of the various components of first mixing path module 20.

An edge element 15 of splitting component 14 transects the entire flow stream and divides the flow stream into two equal halves. One half of the flow stream is guided into first flow path 50 and the other half to the second flow path 60. First flow path 50 and second flow path 60 are preferably fabricated so that there is a change in their cross-sectional dimensions between successive mixing segments 40. This is required so that, when the flow streams of the materials in first flow path 50 and second flow path 60 re-combine in a stacking or layering manner in layering zone 18, the resultant combination has the same cross-sectional dimension as it had prior to engagement with splitting component 14.

As shown in FIG. 2, first flow path 50 is better understood as being formed as part of, or as an impression in, first mixing module 20 and second flow path 60 as being formed as part of, or as an impression in, second mixing module 20'. When viewing first mixing module 20 from the mating side 13, first flow path 50 appears to zigzag about the central axis 11. This would also be true if one viewed the second mixing module 20' in the same way. That is, second flow path 60 appears to zigzag about central axis 11.

Figure 4:
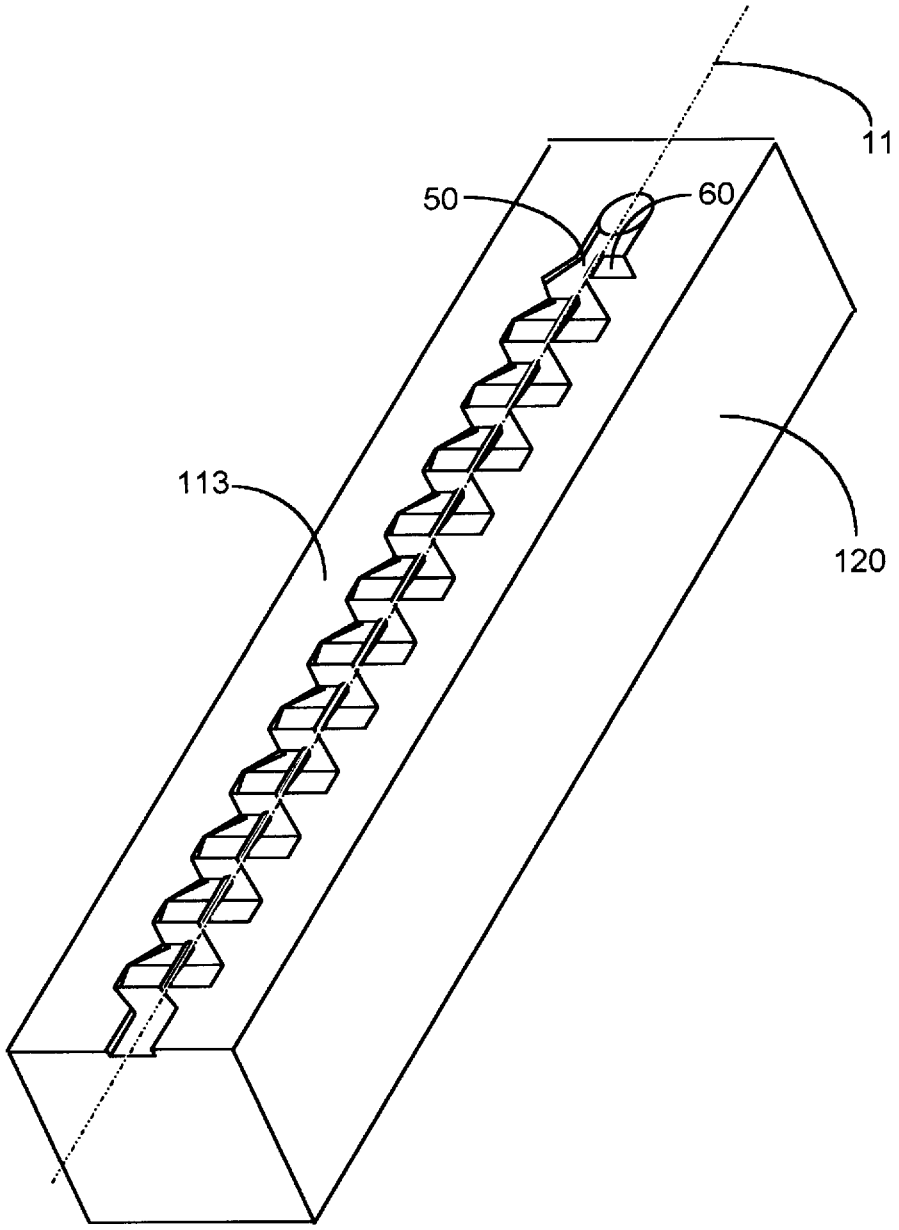
FIG. 4 is a perspective view of a second embodiment of the present invention showing one of the flow paths of the present invention remaining on the same side of the center axis.

FIG. 4 illustrates the second embodiment of the present invention. It shows first mixing module 20, labeled as first mixing component 120, with an alternate configuration of first flow path 50 and second flow path 60. When viewing first mixing component 120 from a mating side 113, first flow path 50 appears like a series of successive waves remaining on one side of axis 11. Upon careful examination of the embodiments illustrated in FIG. 2 and FIG. 4, one can see that either design will perform the mixing of laminar flow streams in the same controlled fashion.

The novel method of mixing laminar flows is accomplished by the present invention without moving parts such as paddles, blades and the like. As the fluidic substances pass through each mixing segment 40, the mixing result at outlet path 26 is predictable because the shaping, stacking and splitting of the flow streams are performed in a controlled manner. The present invention achieves the controlled dividing and stacking, and the resultant mixing which occurs, according to the equation $2^{n+1}$, where "n" represents the number of mixing segments 40 incorporated within the flow path 12. In addition to this "power of two" dividing and stacking, the present invention also reduces the layer thickness of each stack by half every time the material passes through another mixing segment 40. The effect of this action is more clearly explained below. The layer thickness is represented by $\frac{1}{2}^n$, where "n" equals the number of mixing segments 40 that a flowing stream 70 passes through. This is attained because the cross-sectional area is constant throughout the flow path 12. Dividing the thickness of each layer by one-half its previous thickness followed by stacking one layer on top of the other layer in layering zone 18 effectively mixes the flowing material continuously even in laminar flow situations. For example, a device like static mixer 10 having twenty-three repetitions similar to mixing segment 40 will divide a two-component laminar flowing stream into 16,777,216 layers laminated together. Each layer after the twenty-third repetition being $1/16{,}777{,}216$th as thick as the starting layer. Because this mixing can be achieved even in laminar flow situations, the size of the device, unlike prior-art devices, does not affect the present invention's versatility. That is, a fluid stream does not have to exhibit turbulent flow characteristics in order for mixing to occur. From a practical standpoint, miniaturizing the present invention does not affect its functioning with high viscosity fluids. Thus, the present invention works whether made large on an industrial scale or small on a microscopic scale. Also, it can be made by machine, by laser, by etching, or by any means for creating a mixing path 12. In addition, static mixer 10 also accomplishes a thorough mixing in fluidic substances with turbulent flow, i.e. high Reynolds numbers.

Figure 5:
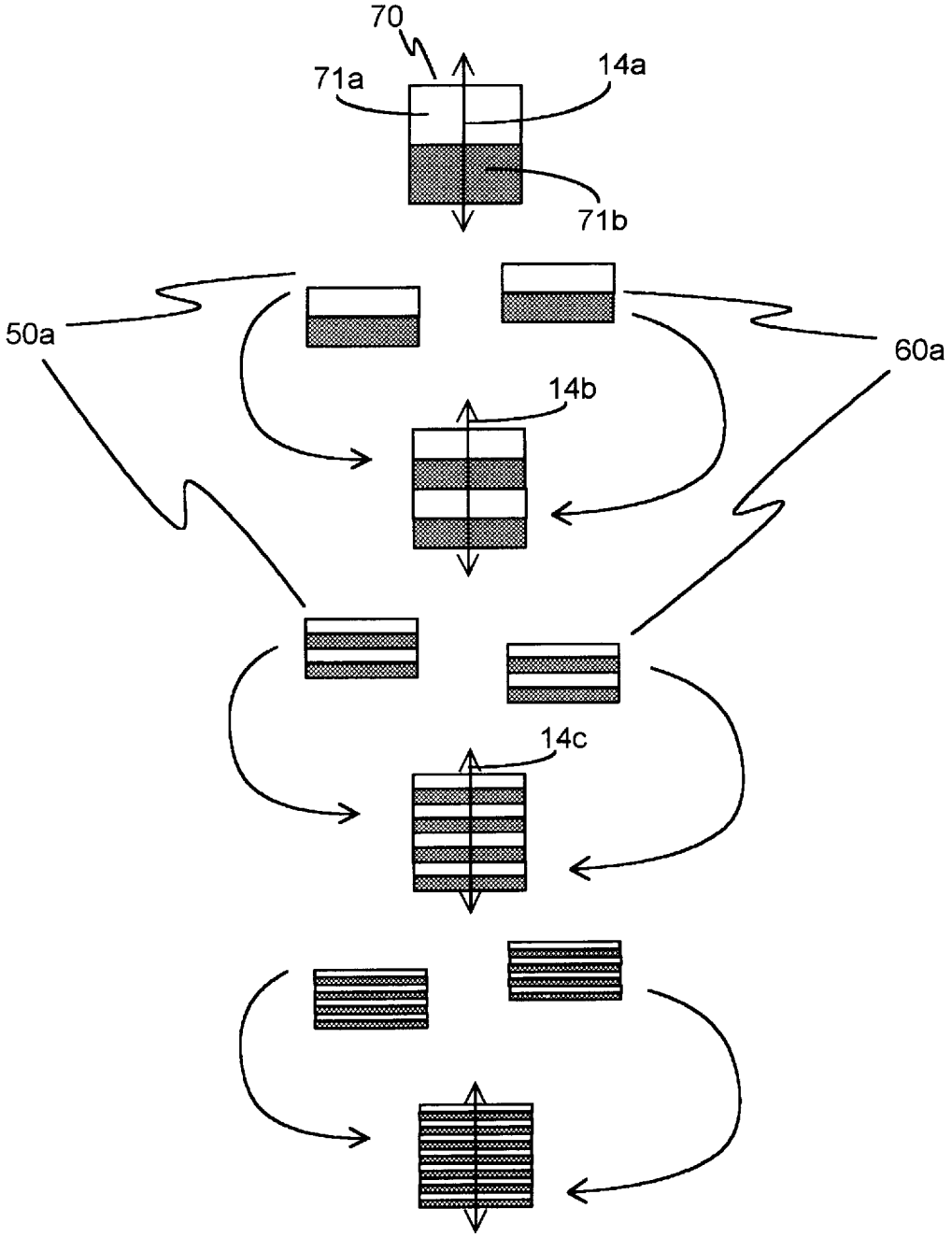
FIG. 5 shows the change in cross-sectional composition, stacking and splitting of a laminar flow stream as it passes through three mixing segments of the first embodiment of the present invention.
Figure 6:
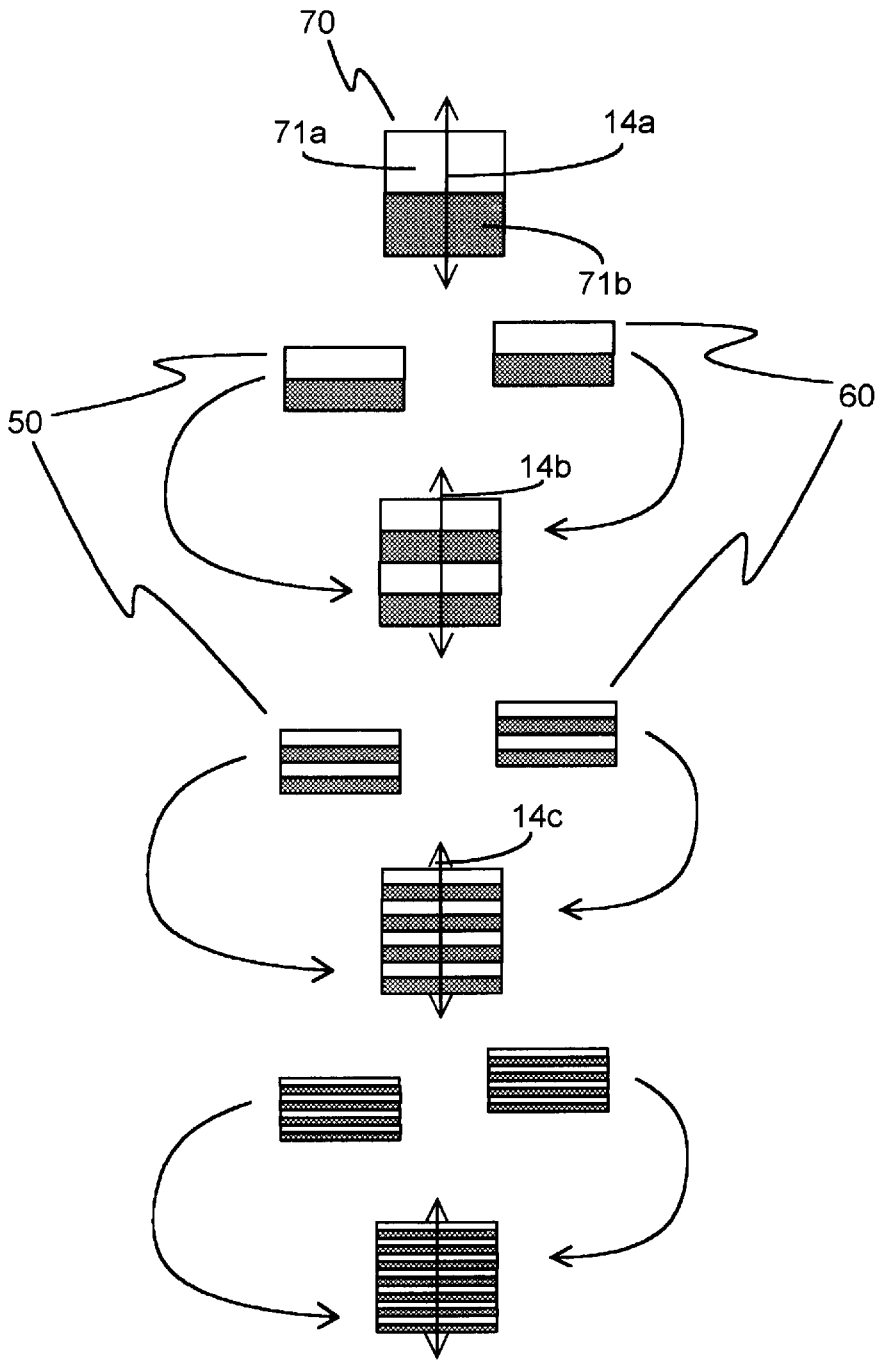
FIG. 6 shows the change in cross-sectional composition, stacking and splitting of a laminar flow stream as it passes through three mixing segments of the second embodiment of the present invention.

FIG. 5 illustrates the dividing and stacking effect on a two-component laminar flow stream passing through three of the mixing segments 40 of mixing path 12 of static mixer 10. Upon initial entry into mixing path 12, a first layer substance 71*a* and a second layer substance 71*b,* which make up flow stream 70, are stacked prior to engagement with the first splitting component 14*a*. Splitting components 14*a,* 14*b* and 14*c* are not drawn to scale, but are shown only for the purpose of illustrating the division of flow stream 70. Immediately after engagement with splitting component 14*a,* one half of the flow stream 70 proceeds along first flow path 50 and the other half proceeds along second flow path 60. As shown in FIG. 5, each half of flow stream 70 beyond splitting component 14*a* contains first layer substance 71*a* and second layer substance 71*b*. For convenience, each half of the flow stream is referenced as first flow stream 50*a* for that half of flow stream 70 that follows first flow path 50 and second flow stream 60*a* for the half that follows second flow path 60, respectively. As mentioned above, the cross-sectional dimensions of first flow stream 50*a* and second flow stream 60*a* change so that when the flow streams 50*a* and 60*a* are re-combined by layering in stacking zone 18, the cross-sectional dimensions of the combination is the same as it existed prior to engagement with first splitting component 14*a*. By following the progression of first flow stream 50*a* and second flow stream 60*a* as they proceed past the first three splitting components 14*a,* 14*b* and 14*c,* one can see that the number of layers of flow streams 50*a* and 60*a* increase by a factor of $2^{n+1}$ and that the layers are halved by a factor of $\frac{1}{2}^{n}$ with each repetition of mixing segment 14. This effect of the dividing, shaping and stacking that static mixer 10 has on laminar flow streams is reproducible and consistent. FIG. 6 shows a similar occurrence for a static mixer 10 having the first mixing component 120 similar to the one shown in FIG. 4. The only difference between FIG. 5 and FIG. 6 is the order of stacking/layering that occurs with first flow stream 50*a* and second flow stream 60*a*. In FIG. 5, first flow stream 50*a* and second flow stream 60*a* alternate their stacking/layering positions relative to each other, while in FIG. 6, they do not.

Figure 7:
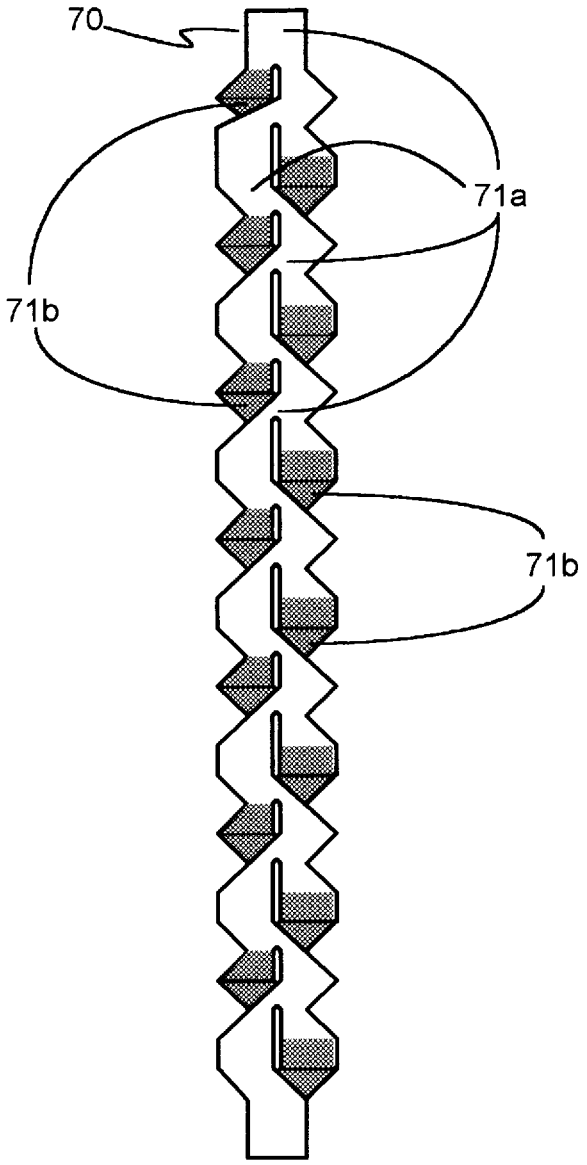
FIG. 7 is a top view of a flow stream passing through the flow paths of the present invention showing the layering as the flow stream passes each splitting element.

The flow stream 70 of static mixer 10 is illustrated in FIG. 7 as a top view of the layered flow stream 70. The first layer substance 71*a* is represented as the top layer of each successive pass through mixing segment 40. The second layer substance 71*b* is represented as the bottom layer.

Figure 8:
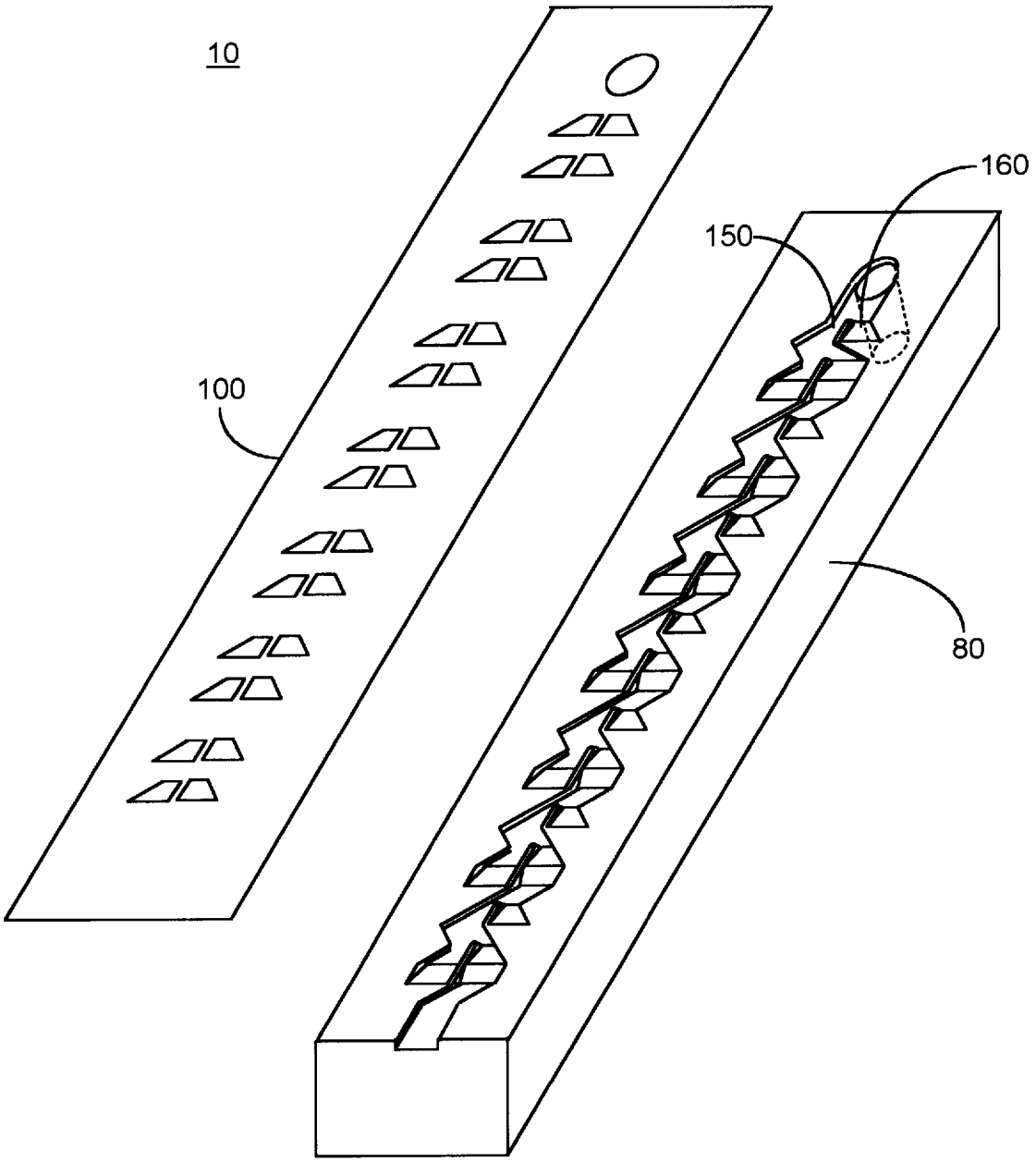
FIG. 8 is a perspective view of a third embodiment of the present invention showing a divider and one-half of the remaining mating portions.

FIG. 8 illustrates a portion of a third embodiment of the present invention. FIG. 8 shows a first mixing module 80 and a divider module 100 of static mixer 10. It is understood that a second mixing module identical to first mixing module 80 is not shown, but is required for a complete assembly of this third embodiment of the present invention. As the length of each mixing segment 40 of static mixer 10 is shortened, the angle of approach between two combining flow streams or paths will increase. The divider module 100 insures that the material in flow path 150 does not mingle, due to the increased angle of approach, with the material in flow path 160 during the stacking/layering phase.

To use the present invention, one would simply input two fluidic substances that one wished to mix into static mixer 10. One substance would enter input path 24 and the second substance would enter input path 24' of first mixing module 20 and second mixing module 20', respectively. Again, the type of flow regime is not critical because static mixer 10 will mix fluidic substances under laminar flow conditions. As the two layered fluidic substances approach the first of a plurality of mixing segments 40, the flow stream will contact the first splitting component 14 dividing the flow stream 70 into two substantially equal halves. Each half will be made up of two layers. One layer being the first substance from input path 24 and the second layer being the second substance from input path 24'.

One half of divided flow stream 70, shown in FIG. 5 as first flow stream 50*a,* will follow first flow path 50 and the other half, shown as second flow stream 60*a,* will follow second flow path 60. The cross-sectional dimensions of the material being mixed in flow paths 50 and 60 will undergo a re-shaping. This re-shaping involves two factors. The first is positioning of each flow stream 50*a* and 60*a* so that, as first flow stream 50*a* re-combines with second flow stream 60*a,* one flow stream will layer to the other flow stream prior to entering the next mixing segment 40. In effect, flow stream 70 is re-created for a short time. The second involves changing the cross-sectional dimensions of flow streams 50*a* and 60*a* so that, when they re-combine in layering zone 18 immediately prior to entering the next mixing segment 40, the combination has the same cross-sectional dimensions as the flow stream 70 had originally. This is important to achieve the "power of 2" layering mentioned earlier. At the outlet path 26, the flow stream 70 having passed through a plurality of mixing segments 40 exits as a thoroughly mixed substance.

Figure 9:
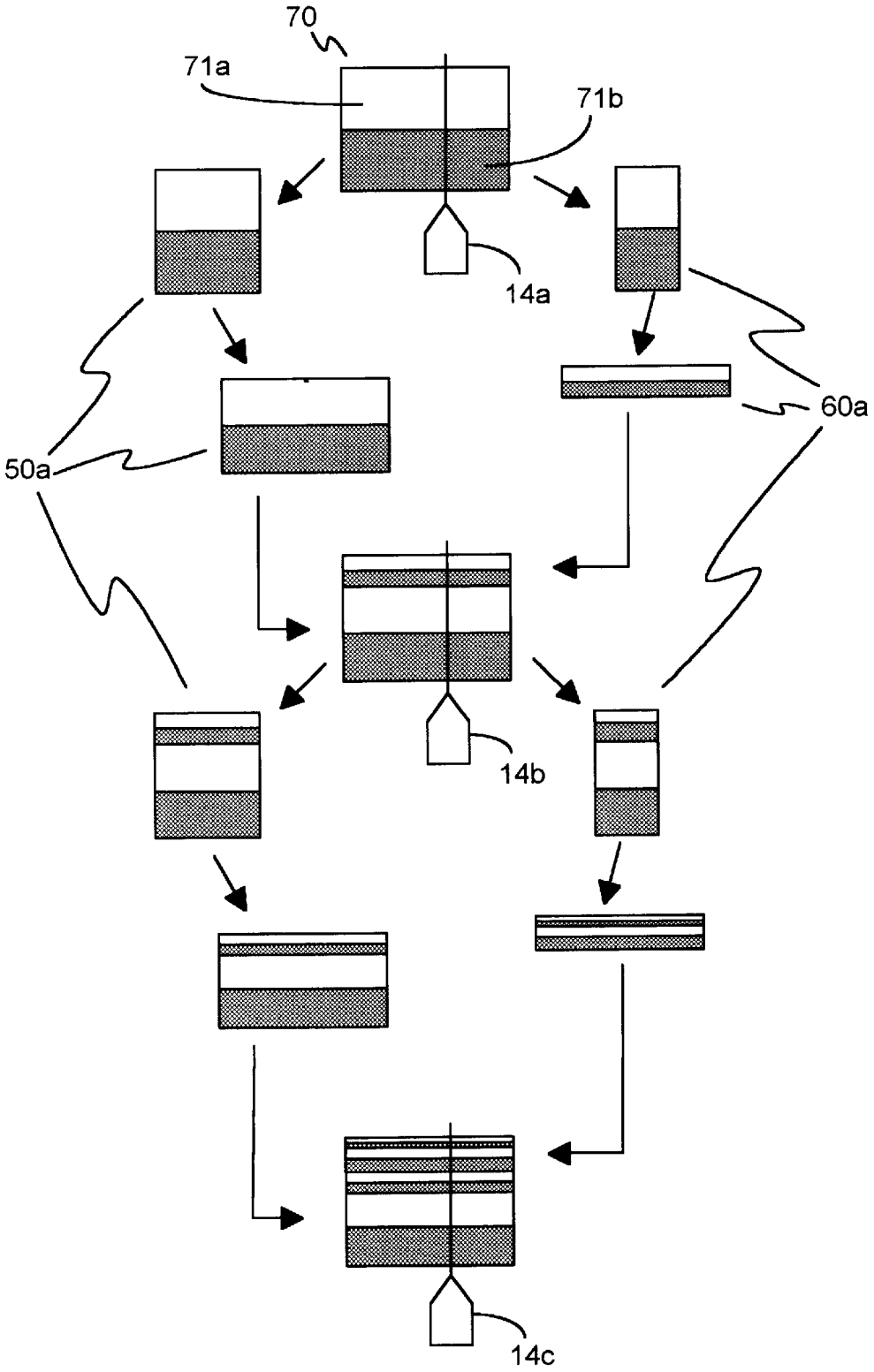
FIG. 9 shows the change in cross-sectional composition, stacking and splitting of a laminar flow stream as it passes through three mixing segments of the present invention where the flow stream is divided into other than substantially equal flows.

As mentioned earlier, the present invention is not limited to using a single splitting component 14 or dividing the flow stream 70 into two substantially equal flow streams 50*a* and 60*a*. FIG. 9 illustrates the dividing and stacking effect on a two-component laminar flow stream passing through three of the mixing segments 40 where the divided flows are not substantially equal. A first layer substance 71*a* and a second layer substance 71*b* are stacked prior to engagement with the first splitting component 14*a*. Immediately after engagement with splitting component 14*a,* one portion of the flow stream 70 proceeds along first flow path 50 and the other half proceeds along second flow path 60. Each half of flow stream 70 beyond splitting component 14*a* contains first layer substance 71*a* and second layer substance 71*b*. For convenience, each portion of the flow stream is referenced as first flow stream 50*a* for that portion that follows first flow path 50 and second flow stream 60*a* for the portion that follows second flow path 60, respectively. As mentioned above, the cross-sectional dimensions of first flow stream 50*a* and second flow stream 60*a* change so that when the flow streams 50*a* and 60*a* are re-combined by stacking within layering zone 18, the cross-sectional dimensions of the combination is the same as it existed prior to engagement with first splitting component 14*a*. By following the progression of first flow stream 50*a* and second flow stream 60*a* as they proceed past the first three splitting components 14*a*, 14*b* and 14*c*, one can see that the number of layers of flow streams 50*a* and 60*a* increase by a factor of $2^{n+1}$.

Figure 10:
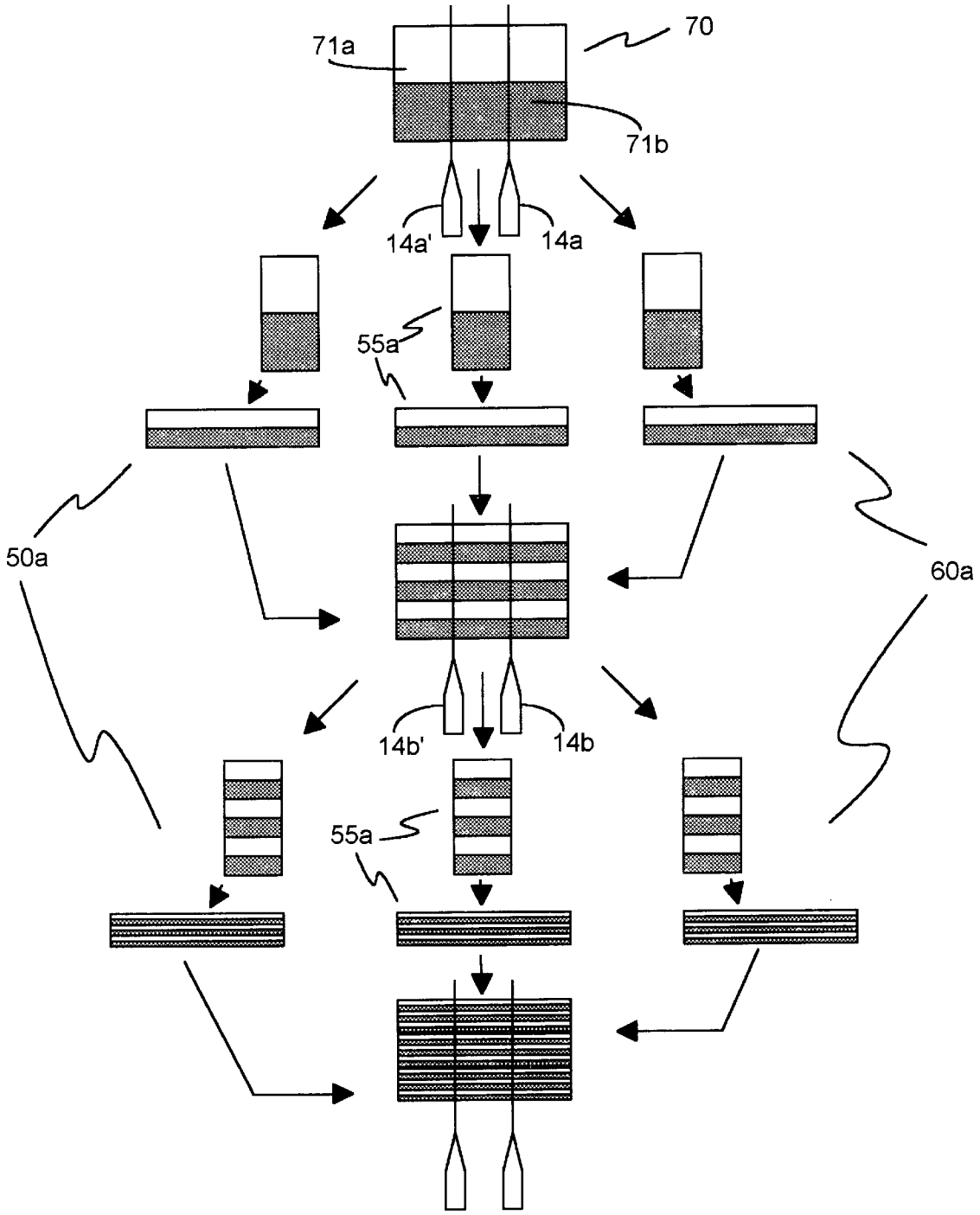
FIG. 10 shows the change in cross-sectional composition, stacking and splitting of a laminar flow stream as it passes through three mixing segments of the present invention where the flow stream is divided into more that two flows.

FIG. 10 illustrates the dividing and stacking effect on a two-component laminar flow stream passing through three of the mixing segments 40 where the flow stream is divided into three substantially equal flows. A first layer substance 71*a* and a second layer substance 71*b* are stacked forming flow stream 70 prior to entering the first mixing segment 40. The stacked layers then engage splitting components 14*a* and 14*a'*. Immediately after engagement with splitting components 14*a* and 14*a'*, each portion of the flow stream 70 proceeds along three flow paths. Each portion of flow stream 70 beyond splitting component 14*a* and 14*a'* contains first layer substance 71*a* and second layer substance 71*b*. For convenience, each portion of the flow stream is referenced as first flow stream 50*a*, second flow stream 55*a* and third flow stream 60*a*. The cross-sectional dimensions of flow streams 50*a*, 55*a* and 60*a* change so that when the flow streams 50*a*, 55*a* and 60*a* are re-combined by stacking within layering zone 18, the cross-sectional dimensions of the combination is the same as it existed prior to engagement with first splitting components 14*a* and 14*a'*. By following the progression of flow streams 50*a*, 55*a* and 60*a* as they proceed past the first three sets of splitting components, one can see that the number of layers of flow streams 50*a*, 55*a* and 60*a* increase by a factor of $fm^n$, where "f" represents the number of "fluids" initially forming flow stream 70, "m" represents the resultant number of flow paths into which flow stream 70 is divided and "n" represents the number of repetitions. In FIG. 10, "f" is equal to 2.

It would be obvious to one skilled in the art that a static mixer can be created which incorporates the previously-mentioned alternatives. That is, a static mixer is fabricated which splits the flow stream into three or more unequal flow portions.

Although the preferred embodiments of the present invention have been described herein, the above descriptions are merely illustrative. Further modification of the invention herein disclosed will occur to those skilled in the respective arts and all such modifications are deemed to be within the scope of the invention as defined by the appended claims.

What is claimed is:

1. A method of mixing two or more fluidic substances comprising:

a) dividing an initial flow stream of two or more fluidic substances into two or more flow streams;

b) moving each of said two or more flow streams into separate flow paths;

c) changing the shape of each of said two or more flow streams while moving through said separate flow paths in preparation for layering and re-combining said two or more flow stream to each other;

d) layering said two or more flow streams to each other creating a unified flow stream, wherein the shape of said unified flow stream has the same shape as said initial flow stream;

e) maintaining the combined cross-sectional area of said two or more flow streams equal to the cross-sectional area of said initial flow stream during the steps of dividing shaping and layering; and f) repeating said steps of dividing, changing and layering at least one or more times.

2. The method as claimed in claim 1 wherein the shape of each of said flow streams is changed proportionally to said initial flow stream.

3. The method as claimed in claim 1 wherein said steps of dividing, moving, changing, and layering are performed a plurality times on said two or more fluidic substances.

4. The method as claimed in claim 1 wherein the number of layers of said unified flow stream increases by a factor of $fm^n$, where f represents the number of said two or more fluidic substances, m represents the number of each of said flow streams and n represents the number of times said dividing, moving, changing, and layering is performed on said two or more fluidic substances.

5. The method as claimed in claim 1 wherein the number of layers of said unified flow stream for two fluidic substances in said initial flow stream increases by a factor of $2^{n+1}$ where n represents the number of times said dividing, moving, changing, and layering is performed.

6. The method as claimed in claim 1 wherein each of said initial flow stream and said unified flow stream has a middle portion and a boundary portion, said middle portion moving from the middle of said flow stream upon dividing into said two or more fluid streams and becoming a boundary portion during the subsequent layering step forming a subsequent unified flow stream.

7. The method as claimed in claim 1 wherein each of said repeating steps of dividing is in substantially planar alignment with each previous step of dividing.

8. A method of mixing two or more flow streams, said method comprising the steps of:

a) layering two or more initial flow streams together forming a combined flow stream;

b) dividing said combined flow stream into two or more separate flow streams;

c) separating said two or more separate flow streams such that each of said separate flow streams diverge from a co-planar relationship to each other;

d) layering said two or more separate flow streams to each other forming a subsequent combined flow stream having the same cross-sectional shape as said previous combined flow stream; and e) repeating said dividing, separating and layering steps at least one or more times.

9. The method as claimed in claim 8 wherein the cross-sectional area of said combined flow stream and said two or more separate flow streams are equal.

10. The method as claimed in claim 8 wherein the number of layers of said combined flow stream increases by a factor of $fm^n$, where f represents the number of said two or more initial flow streams, m represents the number of said two or more separate flow streams and n represents the number of times said dividing, separating and layering is performed on said two or more initial flow streams.

11. The method as claimed in claim 8 wherein the number of layers of said combined flow stream for two of said two or more of said initial flow streams increases by a factor of $2^{n+1}$ where n represents the number of times said dividing, separating and layering is performed.

* * * * *